US011421328B2

(12) United States Patent
Kurashina et al.

(10) Patent No.: US 11,421,328 B2
(45) Date of Patent: Aug. 23, 2022

(54) WATER ELECTROLYSIS SYSTEM AND CONTROL METHOD THEREFOR

(71) Applicant: HONDA MOTOR CO., LTD., Tokyo (JP)

(72) Inventors: Daisuke Kurashina, Wako (JP); Takamitsu Kino, Wako (JP); Yukihiro Fukushima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 316 days.

(21) Appl. No.: 16/848,869

(22) Filed: Apr. 15, 2020

(65) Prior Publication Data

US 2020/0332425 A1 Oct. 22, 2020

(30) Foreign Application Priority Data

Apr. 19, 2019 (JP) ..... JP2019-080092

(51) Int. Cl.

| | |
|---|---|
| ***H01M 8/02*** | (2016.01) |
| ***C25B 1/04*** | (2021.01) |
| ***C25B 15/02*** | (2021.01) |
| ***C25B 9/73*** | (2021.01) |
| ***C25B 9/19*** | (2021.01) |

(52) U.S. Cl.

CPC ..... *C25B 1/04* (2013.01); *C25B 9/19* (2021.01); *C25B 9/73* (2021.01); *C25B 15/02* (2013.01)

(58) Field of Classification Search

CPC ..... H01M 8/02

See application file for complete search history.

(56) References Cited

U.S. PATENT DOCUMENTS

2013/0048507 A1* 2/2013 Kurashina ..... C25B 1/04 204/229.8

FOREIGN PATENT DOCUMENTS

| | | |
|---|---|---|
| JP | 64-085111 | 3/1989 |
| JP | 2000-206013 | 7/2000 |
| JP | 2006-241022 | 9/2006 |
| JP | 2011-168862 | 9/2011 |
| JP | 2012-219276 | 11/2012 |
| JP | 2013-049906 | 3/2013 |
| JP | 2014-223590 | 12/2014 |

* cited by examiner

*Primary Examiner* — Jacob B Marks

(74) *Attorney, Agent, or Firm* — Amin, Turocy & Watson, LLP

(57) ABSTRACT

A water electrolysis system produces hydrogen gas at a higher pressure than oxygen gas. A Peltier cooler is disposed between a gas-liquid separator and a back pressure valve in a hydrogen gas flow path, and cools and dehumidifies the hydrogen gas. A temperature sensor measures a temperature in the vicinity of the Peltier cooler, and outputs a temperature measurement value. A pressure sensor measures a pressure of the hydrogen gas between a cathode and the back pressure valve in the hydrogen gas flow path, and outputs a pressure measurement value. A control unit controls a cooling temperature by the Peltier cooler, in a manner so that the temperature measurement value becomes a target temperature that exceeds the freezing point of water corresponding to the pressure measurement value. At least a portion of the target temperature becomes lower as the pressure measurement value increases.

8 Claims, 3 Drawing Sheets

WATER ELECTROLYSIS SYSTEM AND CONTROL METHOD THEREFOR

CROSS-REFERENCE TO RELATED APPLICATION

This application is based upon and claims the benefit of priority from Japanese Patent Application No. 2019-080092 filed on Apr. 19, 2019, the contents of which are incorporated herein by reference.

BACKGROUND OF THE INVENTION

Field of the Invention

The present invention relates to a water electrolysis system including an anode that generates oxygen gas and a cathode that generates hydrogen gas by electrolysis of water, as well as to a control method for such a water electrolysis system.

Description of the Related Art

In general, hydrogen gas is used as a fuel gas that is used in a power generating reaction of a fuel cell. Such hydrogen gas can be produced, for example, by a water electrolysis system equipped with a water electrolysis device. In the water electrolysis device, a solid polymer electrolyte membrane (ion exchange membrane) is used in order to decompose water and generate hydrogen gas (as well as oxygen gas). An electrolyte membrane assembly is constructed by providing an electrode catalyst layer and a power supplying member on both surfaces of the solid polymer electrolyte membrane, and a unit cell is constructed by disposing separators on both sides of the electrolyte membrane assembly. An anode is constituted by one electrode catalyst layer and the power supplying member of the solid polymer electrolyte membrane, and a cathode is constituted by the other electrode catalyst layer and the power supplying member.

In a cell unit in which a plurality of unit cells are stacked, a voltage is applied to both ends in the stacking direction, and water is supplied to the power supplying members on the anode side. Therefore, in the electrode catalyst layers on the anode side, water is decomposed to generate hydrogen ions (protons) and oxygen gas, the hydrogen ions permeate through the solid polymer electrolyte membranes and move to the cathode side, and hydrogen gas is generated by the hydrogen ions combining with electrons in the electrode catalyst layers. On the other hand, oxygen gas generated at the anodes is discharged from the cell unit along with surplus (unreacted) water.

At the cathodes of the above-described water electrolysis device, hydrogen gas in which moisture is contained (hereinafter, also referred to as unprocessed hydrogen gas) is generated. However, for example, product hydrogen gas to be supplied to a fuel cell vehicle or the like is required to have a desired state of dryness (water concentration), for example, a moisture content of less than or equal to 5 ppm. Thus, for example, in Japanese Laid-Open Patent Publication No. 2013-049906, a water electrolysis system is proposed for producing dehumidified hydrogen gas by separating water from unprocessed hydrogen gas generated by a water electrolysis device. Such a water electrolysis system is equipped with a cooling device for cooling the unprocessed hydrogen gas, and by cooling the unprocessed hydrogen gas by the cooling device and reducing the amount of saturated water vapor therein, the moisture is separated from the unprocessed hydrogen gas to thereby produce dehumidified hydrogen gas.

Further, in such a water electrolysis system, a back pressure valve is provided between a supply port for supplying the produced dehumidified hydrogen gas to the exterior and a cathode of the water electrolysis device, at a location downstream of the cooling device. Therefore, accompanying continuous generation of hydrogen gas by the water electrolysis device, the pressure of the hydrogen gas between the cathode and the back pressure valve rises to a set pressure at which the back pressure valve opens. In the cooling device, since the amount of saturated water vapor tends to decrease as the pressure of the unprocessed hydrogen gas becomes higher, even with a small amount of cooling, it is possible to dehumidify the unprocessed hydrogen gas to a predetermined moisture concentration.

Thus, the current value applied to the cooling device is adjusted in accordance with the pressure of the unprocessed hydrogen gas, in a manner so that the power consumption by the cooling device becomes a minimum value that is capable of dehumidifying the unprocessed hydrogen gas to the predetermined moisture concentration. More specifically, as the pressure of the unprocessed hydrogen gas increases, the current value applied to the cooling device is made smaller. Consequently, for example, as distinct from a temperature swing adsorption method (TSA) that tends to consume a large amount of power, a pressure swing adsorption method (PSA) that tends to require complicated and large-scale equipment, and a method in which a replaceable adsorbent material is used that requires frequent maintenance, it is possible to economically perform dehumidification of unprocessed hydrogen gas with a small and simple configuration, while power consumption can be suppressed to the greatest extent possible.

SUMMARY OF THE INVENTION

The present invention has been devised in relation to this type of technology, and has the object of providing a water electrolysis system which is capable of effectively dehumidifying hydrogen gas with a small and simple configuration, as well as a control method therefor.

One aspect of the present invention is characterized by a water electrolysis system comprising a water electrolysis device including an anode configured to generate oxygen gas and a cathode configured to generate hydrogen gas by electrolysis of water, and a back pressure valve provided in a hydrogen gas flow path through which the hydrogen gas generated at the cathode flows, the water electrolysis system producing the hydrogen gas at a higher pressure than the oxygen gas, the water electrolysis system further comprising a gas-liquid separator disposed between the cathode and the back pressure valve in the hydrogen gas flow path, and configured to separate moisture from the hydrogen gas, a Peltier cooler disposed between the gas-liquid separator and the back pressure valve in the hydrogen gas flow path, at a position higher than the gas-liquid separator, and configured to further separate moisture contained in the hydrogen gas by cooling, by a Peltier element, the hydrogen gas from which the moisture has been separated by the gas-liquid separator, a temperature sensor configured to measure a temperature of the Peltier cooler or a temperature in a vicinity of the Peltier cooler, and to output a temperature measurement value, a pressure sensor configured to measure a pressure of the hydrogen gas between the cathode and the back pressure valve in the hydrogen gas flow path, and to output a pressure measurement value, and a control unit configured to control a cooling temperature by the Peltier cooler on a basis of the pressure measurement value and the temperature measurement value, in a manner so that the temperature measurement value becomes a target temperature that exceeds a freezing point of water corresponding to the pressure measurement value, wherein at least a portion of the target temperature becomes lower as the pressure measurement value increases.

Another aspect of the present invention is characterized by a control method for a water electrolysis system comprising a water electrolysis device including an anode configured to generate oxygen gas and a cathode configured to generate hydrogen gas by electrolysis of water, and a back pressure valve provided in a hydrogen gas flow path through which the hydrogen gas generated at the cathode flows, the water electrolysis system producing the hydrogen gas at a higher pressure than the oxygen gas, the control method comprising a water electrolysis step of initiating electrolysis of water by the water electrolysis device, a pressure measurement step of measuring a pressure of the hydrogen gas between the cathode and the back pressure valve in the hydrogen gas flow path, thereby obtaining a pressure measurement value, and a cooling temperature control step of controlling a cooling temperature by a Peltier cooler provided between the cathode and the back pressure valve in the hydrogen gas flow path, in a manner so that a temperature measurement value, which is obtained by measuring a temperature of the Peltier cooler or a temperature in a vicinity of the Peltier cooler, becomes a target temperature that exceeds a freezing point of water corresponding to the pressure measurement value, wherein at least a portion of the target temperature becomes lower as the pressure measurement value increases.

The freezing point of water contained in the hydrogen gas changes depending on the pressure of the hydrogen gas. The freezing point of water decreases as the pressure of the hydrogen gas becomes higher, and the freezing point of water increases as the pressure of the hydrogen gas becomes lower. By the Peltier cooler of the water electrolysis system, the hydrogen gas is cooled in a manner so that the temperature measurement value becomes a target temperature that exceeds the freezing point of water corresponding to the pressure measurement value of the hydrogen gas. At least a portion of the target temperature becomes lower as the pressure measurement value increases. Therefore, by cooling the hydrogen gas in the manner described above, it is possible to bring the hydrogen gas in proximity to the freezing point, and to effectively reduce the amount of saturated water vapor, within a range in which the moisture contained in the hydrogen gas does not undergo freezing. As a result, with a small and simple configuration in which a Peltier cooler is used, it is possible to effectively dehumidify the hydrogen gas.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Figure 1:
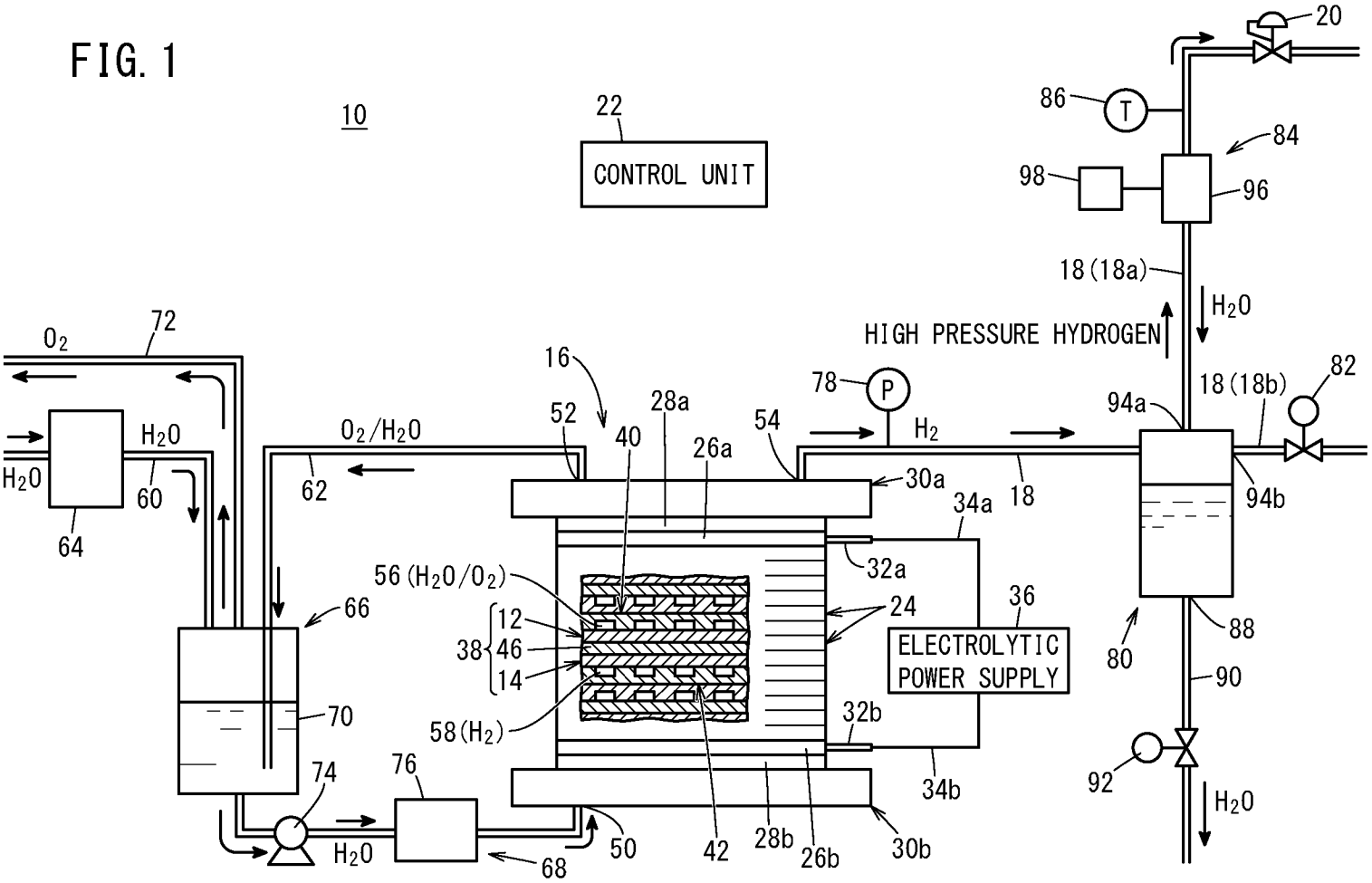
FIG. 1 is a schematic configuration explanatory diagram of a water electrolysis system according to an embodiment of the present invention.

Preferred embodiments of a water electrolysis system and a control method therefor according to the present invention will be presented and described below with reference to the accompanying drawings. In the drawings to be referred to below, constituent elements that exhibit the same or similar functions and effects are denoted with the same reference characters, and repeated description of such features is omitted.

As shown in FIG. 1, a water electrolysis system 10 according to the present embodiment is equipped with a water electrolysis device 16 having anodes 12 for generating oxygen gas and cathodes 14 for generating hydrogen gas by electrolysis of water (pure water), a back pressure valve 20 provided in a hydrogen gas flow path 18 through which the hydrogen gas generated at the cathodes 14 flows, and a control unit 22 for controlling the system as a whole. The water electrolysis system 10 is a differential pressure type water electrolysis system that produces hydrogen gas at a higher pressure than oxygen gas (normal pressure) of the anodes 12.

The water electrolysis device 16 includes a cell unit in which a plurality of unit cells 24 are stacked. A terminal plate 26*a*, an insulating plate 28*a*, and an end plate 30*a* are sequentially arranged in an outward direction at one end in the stacking direction of the unit cells 24. Similarly, a terminal plate 26*b*, an insulating plate 28*b*, and an end plate 30*b* are sequentially arranged in an outward direction at the other end in the stacking direction of the unit cells 24. The end plates 30*a* and 30*b* are fastened and retained in an integral manner. Terminal portions 32*a* and 32*b* are provided in an outwardly projecting manner on side portions of the terminal plates 26*a* and 26*b*. The terminal portions 32*a* and 32*b* are electrically connected via wiring 34*a* and wiring 34*b* to an electrolytic power supply 36.

Each of the unit cells 24, for example, comprises a disk-shaped membrane electrode assembly 38, and a disk-shaped anode side separator 40 and a disk-shaped cathode side separator 42 which sandwich the membrane electrode assembly 38 therebetween. Each of the membrane electrode assemblies 38, for example, is equipped with a solid polymer electrolyte membrane 46 in which a thin film of perfluorosulfonic acid is impregnated with water, and the anode 12 and the cathode 14 provided on both surfaces of the solid polymer electrolyte membrane 46.

Although not illustrated, each of the anodes 12 includes an anode electrode catalyst layer formed on one surface of the solid polymer electrolyte membrane 46, and an anode side power supplying member. Although not illustrated, each of the cathodes 14 includes a cathode electrode catalyst layer formed on another surface of the solid polymer electrolyte membrane 46, and a cathode side power supplying member. The anode electrode catalyst layer, for example, uses a ruthenium (Ru)-based catalyst, whereas the cathode electrode catalyst layer, for example, uses a platinum catalyst.

A water supplying communication hole 50, a discharge communication hole 52, and a hydrogen communication hole 54, which enable the unit cells 24 to communicate respectively in the stacking direction, are provided on outer peripheral edge portions of the unit cells 24. On a surface of the anode side separator 40 facing the membrane electrode assembly 38, a first flow path 56 is provided that communicates with the water supplying communication hole 50 and the discharge communication hole 52. The first flow path 56 is provided within a range corresponding to the surface area of the anode side power supplying member, and includes a plurality of flow grooves, a plurality of embossments, and the like. Water (pure water) is supplied to the first flow path 56 via the water supplying communication hole 50. Further, the first flow path 56 discharges an anode discharge fluid including the oxygen gas generated at the anodes 12 and excess water to the discharge communication hole 52.

A second flow path 58 that communicates with the hydrogen communication hole 54 is formed on a surface of the cathode side separator 42 facing the membrane electrode assembly 38. The second flow path 58 is provided within a range corresponding to the surface area of the cathode side power supplying member, and includes a plurality of flow grooves, a plurality of embossments, and the like. The second flow path 58 discharges the hydrogen gas generated at the cathodes 14 to the hydrogen communication hole 54.

The water electrolysis system 10 includes a water supply flow path 60 that communicates with the water supplying communication hole 50, an anode discharge flow path 62 that communicates with the discharge communication hole 52, and the hydrogen gas flow path 18 that communicates with the hydrogen communication hole 54. Water is supplied to the anodes 12 of the water electrolysis device 16 via the water supply flow path 60 and the water supplying communication hole 50. The anode discharge fluid generated at the anodes 12 flows into the anode discharge flow path 62 through the discharge communication hole 52. The hydrogen gas generated at the cathodes 14 flows into the hydrogen gas flow path 18 via the hydrogen communication hole 54.

A water supplying device 64, a water storage device 66, and a water circulation device 68 are provided in the water supply flow path 60. The water supplying device 64 generates pure water, for example, from tap water or the like, and supplies the pure water to the water storage device 66. The water storage device 66 includes a tank unit 70 in which the pure water supplied from the water supplying device 64 is stored. Further, in the water storage device 66, the anode discharge fluid is supplied through the anode discharge flow path 62, and the anode discharge fluid is separated into water and oxygen gas. The water separated from the anode discharge fluid is stored in the tank unit 70 together with the aforementioned pure water, and the oxygen gas separated from the anode discharge fluid flows into an oxygen gas flow path 72.

The water circulation device 68 includes a circulation pump 74 and an ion exchanger 76. The circulation pump 74 causes the water to be circulated between the water storage device 66 and the water electrolysis device 16 via the water supply flow path 60 and the anode discharge flow path 62.

The ion exchanger 76 removes impurities from the water before the water is supplied to the water supplying communication hole 50.

In addition to the back pressure valve 20, a pressure sensor 78, a gas-liquid separator 80, a pressure release valve 82, a Peltier cooler 84, and a temperature sensor 86 are provided in the hydrogen gas flow path 18. At a time that the back pressure valve 20 is closed, the pressure of the hydrogen gas (hereinafter, also referred to as a hydrogen pressure) between the cathodes 14 and the back pressure valve 20 in the hydrogen gas flow path 18 is increased to a set pressure, and the back pressure valve 20 is opened when the set pressure is reached. Therefore, the high pressure hydrogen gas that has reached the set pressure is supplied to the hydrogen gas flow path 18 downstream of the back pressure valve 20. The set pressure can be set, for example, within a range of 1 to 90 MPa. Further, in the case that the product hydrogen gas produced by the water electrolysis system 10 is supplied to, for example, a hydrogen tank or the like of a fuel cell vehicle, the set pressure is preferably set within a range of 70 to 85 MPa.

The pressure sensor 78 measures the hydrogen pressure, and outputs a pressure measurement value to the control unit 22. According to the present embodiment, the pressure sensor 78 is disposed between the cathodes 14 and the gas-liquid separator 80 in the hydrogen gas flow path 18. However, the pressure sensor 78 may be provided at any location in the hydrogen gas flow path 18, insofar as it is possible to measure the hydrogen pressure between the cathodes 14 and the back pressure valve 20.

The gas-liquid separator 80 is disposed between the cathodes 14 and the back pressure valve 20 in the hydrogen gas flow path 18, and separates moisture from the hydrogen gas (hereinafter, also referred to as unprocessed hydrogen gas) that is generated at the cathodes 14, to thereby produce first dehumidified hydrogen gas. The moisture separated from the unprocessed hydrogen gas is capable of flowing into a drainage flow path 90 via a liquid discharge port 88 of the gas-liquid separator 80. The drainage flow path 90 is opened and closed by a drainage valve 92.

According to the present embodiment, two gas discharge ports 94*a* and 94*b*, which communicate respectively with the hydrogen gas flow path 18 and serve as discharge ports for discharging the first dehumidified hydrogen gas, are provided respectively in the gas-liquid separator 80. Therefore, the hydrogen gas flow path 18 branches into a first hydrogen gas flow path 18*a* that communicates with one gas discharge port 94*a*, and a second hydrogen gas flow path 18*b* that communicates with another gas discharge port 94*b* of the gas-liquid separator 80. Hereinafter, the first hydrogen gas flow path 18*a* and the second hydrogen gas flow path 18*b* may also be collectively referred to as the hydrogen gas flow path 18.

The Peltier cooler 84, the temperature sensor 86, and the back pressure valve 20 are provided in the first hydrogen gas flow path 18*a* in this order from the upstream side to the downstream side in the flow direction of the hydrogen gas. Further, the pressure release valve 82 is provided in the second hydrogen gas flow path 18*b*. More specifically, the pressure release valve 82 is disposed between the cathodes 14 and the Peltier cooler 84 in the hydrogen gas flow path 18, and except when the pressure release valve 82 is in the open state, the first dehumidified hydrogen gas flows into the first hydrogen gas flow path 18*a*. On the other hand, when the pressure release valve 82 is in the open state, the first dehumidified hydrogen gas is discharged through the second hydrogen gas flow path 18*b*, whereby it becomes possible to release the pressure between the cathodes 14 and the back pressure valve 20 in the hydrogen gas flow path 18.

The Peltier cooler 84 is disposed between the gas-liquid separator 80 and the back pressure valve 20 in the hydrogen gas flow path 18 (the first hydrogen gas flow path 18*a*), at a position higher than the gas-liquid separator 80, and cools the first dehumidified hydrogen gas using a Peltier element 96 to thereby cause a reduction in the amount of saturated water vapor. Consequently, the Peltier cooler 84 further separates the moisture contained in the first dehumidified hydrogen gas, to thereby produce second dehumidified hydrogen gas in a desired state of dryness (moisture content). The moisture separated from the first dehumidified hydrogen gas descends inside the first hydrogen gas flow path 18*a* by gravity and flows into the gas-liquid separator 80, and as described above, is capable of flowing into the drainage flow path 90 via the liquid discharge port 88 together with the moisture separated from the unprocessed hydrogen gas. The unprocessed hydrogen gas, the first dehumidified hydrogen gas, and the second dehumidified hydrogen gas may also be simply referred to as hydrogen gas.

The second dehumidified hydrogen gas discharged from the water electrolysis system 10 via the back pressure valve 20, and more specifically, the second dehumidified hydrogen gas the pressure of which has been raised to the set pressure and dehumidified to the desired moisture content becomes the product hydrogen gas that is produced by the water electrolysis system 10. In the case that such a product hydrogen gas is supplied, for example, to a hydrogen tank or the like of a fuel cell vehicle, the desired moisture content of the second dehumidified hydrogen gas is preferably less than or equal to 5 ppm.

According to the present embodiment, the Peltier cooler 84, in addition to the Peltier element 96, is equipped with a switching unit 98 that turns on or off the drive current supplied in a cooling direction of the Peltier element 96. Moreover, in the Peltier element 96, by supplying the drive current in the cooling direction, the temperature of a portion of the Peltier element 96 that exchanges heat with the first dehumidified hydrogen gas is lowered. On the other hand, in the Peltier element 96, by supplying the drive current in a heating direction which is opposite to the cooling direction, the temperature of the portion of the Peltier element 96 that exchanges heat with the first dehumidified hydrogen gas is raised. Further, although not illustrated, the Peltier cooler 84 may be equipped with, for example, a heat sink and a fan for releasing heat on a high temperature side of the Peltier element 96, or a coolant pipe for effecting heat exchange between the coolant and the high temperature side of the Peltier element 96.

The temperature sensor 86 is disposed in close proximity to the Peltier cooler 84 (Peltier element 96) in the hydrogen gas flow path 18, measures a temperature in the vicinity of the Peltier cooler 84, and outputs a temperature measurement value to the control unit 22. Further, the temperature sensor 86 may be provided in the Peltier cooler 84 (Peltier element 96), may measure the temperature of the Peltier cooler 84, and may output the temperature measurement value.

The control unit 22 is configured in the form of a microcomputer equipped with a CPU, memories, and the like (none of which are shown). The CPU executes predetermined computations according to a control program, and performs various processes and controls related to the water electrolysis system 10. Further, the control unit 22 controls the cooling temperature by the Peltier cooler 84, in a manner so that the temperature measurement value detected by the temperature sensor 86 becomes a target temperature that exceeds the freezing point of water corresponding to the pressure measurement value detected by the pressure sensor 78. At least a portion of the target temperature becomes lower as the pressure measurement value increases.

Figure 2:
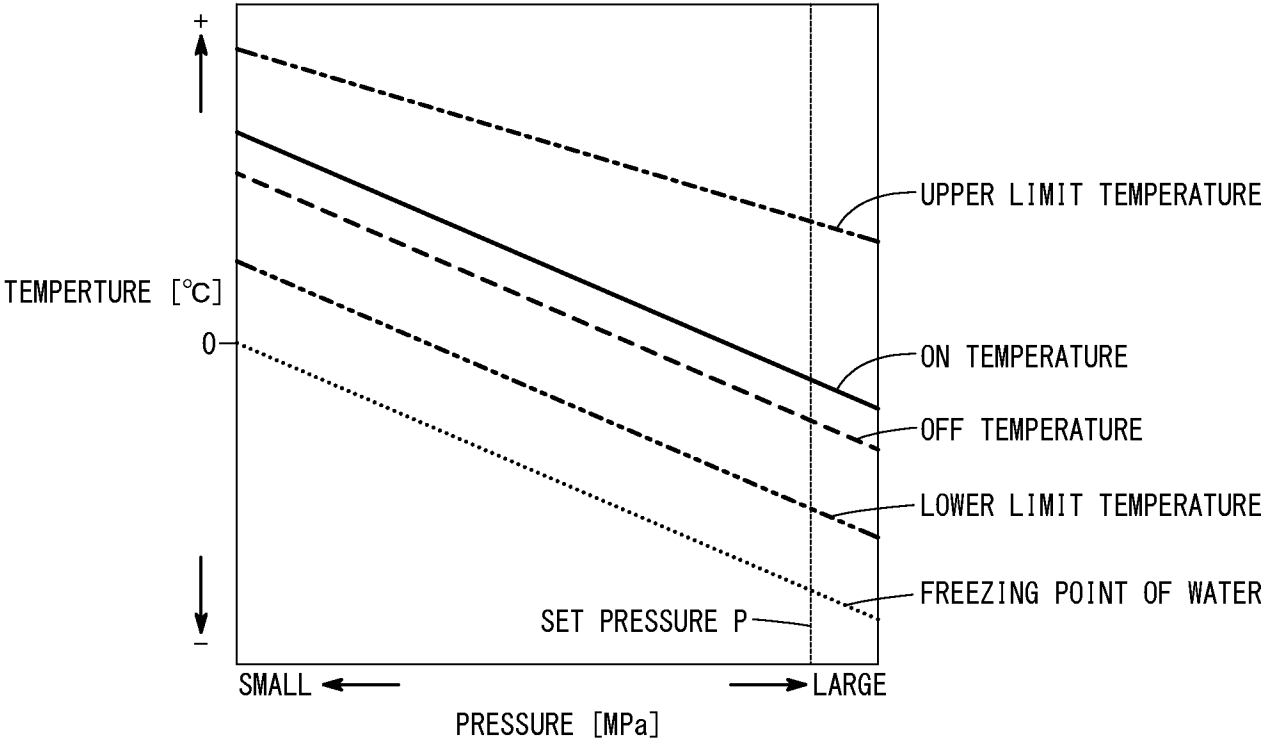
FIG. 2 is a map diagram showing relationships among hydrogen pressure, the freezing point of water, an on temperature, an off temperature, a lower limit temperature, and an upper limit temperature.

More specifically, on the basis of the map shown in FIG. 2, the control unit 22 controls the drive current that is supplied in the cooling direction of the Peltier element 96 to be turned on or off by the switching unit 98. Stated otherwise, in FIG. 2, the target temperature is set within a range between a vicinity of a determination temperature (hereinafter also referred to as an off temperature) for turning off the drive current, as indicated by the dashed line, and a vicinity of a determination temperature (hereinafter also referred to as an on temperature) for turning on the drive current, as indicated by the solid line.

The freezing point of water contained in the hydrogen gas that is cooled by the Peltier cooler 84 changes in accordance with the hydrogen pressure. More specifically, the freezing point of water decreases as the hydrogen pressure becomes higher, and the freezing point of water increases as the hydrogen pressure becomes lower. Therefore, the target temperature is set so as to change in accordance with a change in the freezing point of water corresponding to the hydrogen pressure, and according to the present embodiment, the totality of the target temperature becomes lower as the hydrogen pressure becomes higher, and becomes higher as the hydrogen pressure becomes lower. Moreover, the target temperature may be set so as to remain constant, for example, at a value greater than or equal to a predetermined hydrogen pressure such as the set pressure.

Further, the target temperature is set such that, for example, when the cooling temperature is controlled by the control unit 22, even in the case that a control error occurs or a measurement error of the temperature sensor 86 is included in the temperature measurement value, the temperature (measurement temperature) in the vicinity of the Peltier cooler 84, and consequently the temperature of the hydrogen gas cooled by the Peltier cooler 84 are brought as close as possible to the freezing point of water, while being prevented from becoming less than or equal to the freezing point of water. By setting the target temperature in this manner, it is possible to reduce, to the greatest extent possible, the amount of saturated water vapor in the first dehumidified hydrogen gas, while preventing the moisture contained in the first dehumidified hydrogen gas from freezing. Therefore, it becomes possible to obtain the second dehumidified hydrogen gas, which has been effectively dehumidified so as to have a desired moisture content. Moreover, as shown in FIG. 2, for example, when the hydrogen pressure is greater than or equal to the set pressure of the back pressure valve 20, the target temperature is preferably set to become less than or equal to 0° C.

Further, the control unit 22 shown in FIG. 1 opens the pressure release valve 82 in the case that the temperature measurement value has fallen below the lower limit temperature, or in the case that the temperature measurement value has exceeded the upper limit temperature. As shown by the two-dot dashed line in FIG. 2, the lower limit temperature is set to be lower than the target temperature. When the temperature measurement value falls below the lower limit temperature, then depending on the magnitude of the aforementioned control error or the measurement error, there is a concern that the hydrogen gas may reach the freezing point, and the moisture contained in the hydrogen gas may freeze. Therefore, in the case that the temperature measurement value has fallen below the lower limit temperature, the control unit 22 opens the pressure release valve 82, and suppresses the supply of hydrogen gas to the Peltier cooler 84. In accordance with this feature, it is possible to avoid a situation in which the hydrogen gas flow path 18 and the like become blocked by frozen moisture.

On the other hand, as shown by the one-dot dashed line in FIG. 2, the upper limit temperature is set to be higher than the target temperature. When the temperature measurement value exceeds the upper limit temperature, a concern arises in that the first dehumidified hydrogen gas may not be sufficiently cooled by the Peltier cooler 84, and the second dehumidified hydrogen gas may not be dehumidified to the desired moisture content. Therefore, in the case that the temperature measurement value exceeds the upper limit temperature, the control unit 22 opens the pressure release valve 82 and causes a reduction in the hydrogen pressure, thereby closing the back pressure valve 20. Consequently, it is possible to avoid a situation in which the product hydrogen gas which has not been dehumidified to the desired moisture content is supplied from the water electrolysis system 10.

As described above, the control unit 22 may store, in a memory, the off temperature, the on temperature, the upper limit temperature, and the lower limit temperature that have been determined in advance as functions of the hydrogen pressure, in the form of the map shown in FIG. 2.

Furthermore, prior to initiating electrolysis of water (water electrolysis) by the water electrolysis device 16, the control unit 22 compares the temperature measurement value with the preset starting temperature, and in the case that the temperature measurement value is higher than the starting temperature, turns on the drive current in the cooling direction of the Peltier cooler 84, and thereby lowers the cooling temperature. Consequently, after the temperature measurement value has reached the starting temperature, the electrolytic power supply 36 of the water electrolysis device 16 is turned on to initiate water electrolysis. Moreover, the starting temperature may be set in a manner so that, when the hydrogen gas generated by initiation of water electrolysis has arrived at the Peltier cooler 84, the hydrogen gas can be efficiently cooled to the target temperature in the Peltier cooler 84.

The water electrolysis system 10 according to the present embodiment is basically configured in the manner described above. An example of a control method for the water electrolysis system 10 according to the present embodiment will be described while following along with the flowchart shown in FIG. 3. According to the control method, as a preparatory step prior to initiating the water electrolysis process in the water electrolysis device 16, the temperature measurement value and the starting temperature are compared, and in the case that the temperature measurement value is higher than the starting temperature, the cooling temperature by the Peltier cooler 84 is controlled, and the temperature measurement value is lowered to the starting temperature (step S1).

In the case that the temperature measurement value is less than or equal to the starting temperature in the preparatory step, or in the case that the temperature measurement value has reached the starting temperature by controlling the cooling temperature in the preparatory step, a water electrolysis step of initiating water electrolysis by the water electrolysis device 16 is carried out (step S2). In the water electrolysis step, as shown in FIG. 1, at first, pure water is generated by the water supplying device 64, and is supplied to the tank unit 70 of the water storage device 66. Further, under the action of the circulation pump 74 of the water circulation device 68, water is supplied from the tank unit 70 to the water supplying communication hole 50 of the water electrolysis device 16 via the ion exchanger 76. Therefore, in each of the unit cells 24, water is supplied from the water supplying communication hole 50 to the first flow path 56 of the anode side separator 40, and the water moves along the interior of the anode side power supplying member.

At this time, a voltage is applied via the electrolytic power supply 36 to the terminal portions 32*a* and 32*b* of the terminal plates 26*a* and 26*b*. Therefore, the water supplied to the anode side power supplying member is subjected to electrolysis at the anode electrode catalyst layer, and in accordance therewith, hydrogen ions, electrons, and oxygen gas are generated. The hydrogen ions generated in this manner permeate through the solid polymer electrolyte membrane 46, move to the cathode electrode catalyst layer, are combined with electrons and become hydrogen. Stated otherwise, hydrogen gas is generated at the cathodes 14. The hydrogen gas flows along the second flow path 58 formed between the cathode side separator 42 and the cathode side power supplying member, and flows into the hydrogen gas flow path 18 via the hydrogen communication hole 54.

On the other hand, the oxygen gas generated at the anodes 12 and surplus (unreacted) water are discharged as an anode discharge fluid to the anode discharge flow path 62 via the first flow path 56 and the discharge communication hole 52. The anode discharge fluid, which is supplied to the water storage device 66 through the anode discharge flow path 62, is separated into oxygen gas and water, and the oxygen gas is discharged via the oxygen gas flow path 72 to the exterior of the water electrolysis system 10. The water is stored in the tank unit 70, and together with the pure water that has been supplied to the tank unit 70 from the water supplying device 64, after impurities therein have been removed by the ion exchanger 76, the water is introduced again to the water supplying communication hole 50 under the operation of the circulation pump 74. More specifically, the water is circulated between the water storage device 66 and the water electrolysis device 16 via the water supply flow path 60 and the anode discharge flow path 62.

As described above, when the water electrolysis process is performed by the water electrolysis device 16 and hydrogen gas is continuously generated, the hydrogen pressure rises until it reaches the set pressure of the back pressure valve 20. A pressure measurement step of measuring the hydrogen pressure by the pressure sensor 78 and obtaining a pressure measurement value is performed (step S3 of FIG. 3). The back pressure valve 20 may be controlled to be opened and closed on the basis of the result of a comparison made by the control unit 22 between the pressure measurement value and the set pressure.

Figure 3:
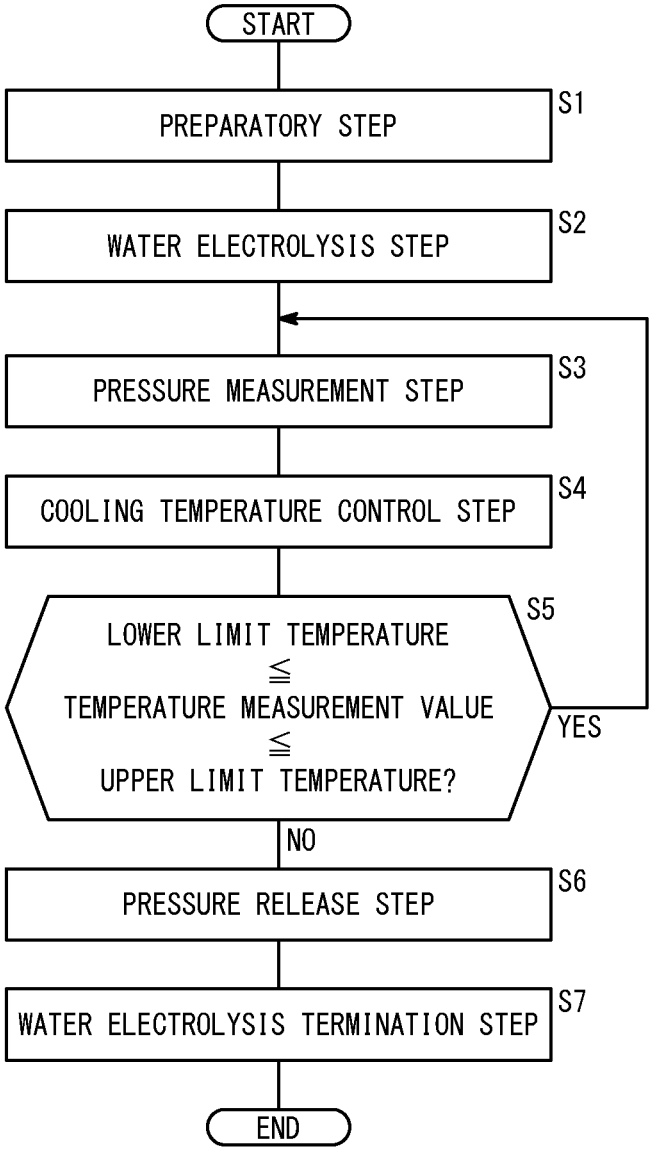
FIG. 3 is a flowchart for describing a control method for the water electrolysis system according to the embodiment of the present invention.

Next, the control unit 22 performs a cooling temperature control step of controlling the cooling temperature by the Peltier cooler 84, in a manner so that the temperature measurement value obtained by the temperature sensor 86 becomes a target temperature that exceeds the freezing point of water corresponding to the pressure measurement value obtained in the pressure measurement step (step S4 of FIG. 3). More specifically, based on the map shown in FIG. 2, in the case that the temperature measurement value is greater than or equal to the on temperature, the drive current is supplied in the cooling direction of the Peltier element 96 to thereby lower the cooling temperature.

On the other hand, in the case that the temperature measurement value is less than or equal to the off temperature, supply of the drive current to the Peltier element 96 is stopped, thereby causing the cooling temperature to rise. Consequently, the cooling temperature can be controlled in a manner so that the temperature measurement value becomes the target temperature that is set between the vicinity of the on temperature and the vicinity of the off temperature. As a result, in the Peltier cooler 84, the first dehumidified hydrogen gas can be brought as close as possible to the freezing point in accordance with the pressure thereof, within a range in which the moisture contained in the first dehumidified hydrogen gas does not freeze. Consequently, it is possible to effectively reduce the amount of saturated water vapor in the first dehumidified hydrogen gas, and therefore, it becomes possible to obtain the second dehumidified hydrogen gas which has been dehumidified to the desired moisture content.

At this time, since the back pressure valve 20 is closed, the hydrogen pressure rises until reaching the set pressure that is set within a range of 70 to 85 MPa, for example. More specifically, the Peltier cooler 84, which is disposed more on the side of the cathodes 14 than the back pressure valve 20 in the hydrogen gas flow path 18, cools the first dehumidified hydrogen gas in which the amount of saturated water vapor and the flow rate thereof have been lowered by an amount corresponding to the rise in pressure from normal temperature. Owing to this feature as well, it is possible to effectively dehumidify the first dehumidified hydrogen gas. As a result, in the water electrolysis system 10, it becomes possible to produce the product hydrogen gas in which the second dehumidified hydrogen gas having a desired moisture content is increased in pressure to the set pressure.

Moreover, from the standpoint of effectively reducing the moisture content of the second dehumidified hydrogen gas, it is preferable that at least a portion of the target temperature be less than or equal to 0° C. For this purpose, for example, in the cooling temperature control step, it is preferable to control the cooling temperature in a manner so that the target temperature of less than or equal to 0° C. is established during steady operation of the water electrolysis system 10 after the hydrogen pressure has reached the aforementioned set pressure. In the case that the hydrogen pressure is increased to the aforementioned set pressure, since the freezing point of water is also reduced in accordance with the hydrogen pressure, a situation is avoided in which the moisture contained in the hydrogen gas freezes even if the temperature measurement value is set to the target temperature of less than or equal to 0° C.

Further, according to the water electrolysis system 10, as described above, in addition to the case in which the pressure measurement value changes during rising of the hydrogen pressure by the hydrogen gas being continuously generated in the water electrolysis step, there are cases in which the pressure measurement value changes during decrease of the hydrogen pressure due to decrease of the amount of hydrogen gas generated by the water electrolysis device 16, stoppage of the generation of hydrogen gas, or certain other factors. In any of such cases, as has been described above, the cooling temperature is controlled in a manner so that the target temperature exceeds the freezing point of water corresponding to the pressure measurement value, whereby it is possible to obtain the second dehumidified hydrogen gas which is effectively dehumidified to the desired moisture content, by bringing the first dehumidified hydrogen gas as close as possible to the freezing point within a range in which the moisture contained in the first dehumidified hydrogen gas does not freeze.

Next, the control unit 22 performs a release pressure determination step of determining whether or not the temperature measurement value lies within a range greater than or equal to the lower limit temperature and less than or equal to the upper limit temperature (step S5 of FIG. 3). In the case it is determined in the pressure release determination step that the temperature measurement value lies within the range greater than or equal to the lower limit temperature and less than or equal to the upper limit temperature (step S5 of FIG. 3: YES), the process returns to the pressure measurement step of step S3. By performing the cooling temperature control step of step S4 on the basis of the pressure measurement value obtained in the pressure measurement step, the cooling temperature is controlled in a manner so that the temperature measurement value becomes the target temperature corresponding to the pressure measurement value regardless of any change in the pressure measurement value, and the production of the second dehumidified hydrogen gas having the desired moisture content can be continued.

On the other hand, in the case it is determined in the pressure release determination step that the temperature measurement value does not lie within the range greater than or equal to the lower limit temperature and less than or equal to the upper limit temperature (step S5 of FIG. 3: NO), a pressure release step of opening the pressure release valve 82 and releasing the pressure between the cathodes 14 and the back pressure valve 20 in the hydrogen gas flow path 18 is performed (step S6 of FIG. 3). By opening the pressure release valve 82, the first dehumidified hydrogen gas flows through the second flow path 58, and therefore, the flow rate of the first dehumidified hydrogen gas supplied to the Peltier cooler 84 can be reduced or set to zero. Further, by opening the pressure release valve 82, the hydrogen pressure becomes lower than the set pressure, whereby the back pressure valve 20 is placed in a closed state.

As discussed above, when the temperature measurement value falls below the lower limit temperature, a concern arises in that the moisture contained in the hydrogen gas may freeze. Therefore, in the case that the temperature measurement value has fallen below the lower limit temperature, the pressure release valve 82 is opened to thereby suppress the supply of hydrogen gas to the Peltier cooler 84, whereby it is possible to avoid a situation in which, for example, the hydrogen gas is cooled until the moisture contained in the hydrogen gas becomes frozen, and the hydrogen gas flow path 18 or the like becomes blocked. On the other hand, when the temperature measurement value exceeds the upper limit temperature, a concern arises in that the amount of saturated water vapor in the hydrogen gas may not be sufficiently lowered, and the second dehumidified hydrogen gas may not be dehumidified to the desired moisture content. Therefore, in the case that the temperature measurement value exceeds the upper limit temperature, the pressure release valve 82 is opened and the back pressure valve 20 is placed in a closed state, whereby a situation can be avoided in which the product hydrogen gas which is not dehumidified to the predetermined moisture concentration is supplied from the water electrolysis system 10.

Further, as noted above, in the case it is determined in the pressure release determination step that the temperature measurement value does not lie within the range greater than or equal to the lower limit temperature and less than or equal to the upper limit temperature, a concern arises in that the cooling temperature of the Peltier cooler 84 may not be normally controlled. In this case, unlike the situation when the water electrolysis device 16 is abnormal or when the hydrogen gas flow path 18 or the like is blocked, there is little need to turn off the power of the electrolytic power supply 36 and the various solenoid valves provided in the water electrolysis system 10 to forcibly stop the water electrolysis process in a state in which a differential pressure is generated between the anodes 12 and the cathodes 14, or to circulate the hydrogen gas in the hydrogen gas flow path 18 in a direction opposite to the normal direction.

Therefore, as discussed previously, in the case it is determined that the temperature measurement value does not lie within the range greater than or equal to the lower limit temperature and less than or equal to the upper limit temperature, by performing the pressure release step instead of forcibly stopping the water electrolysis process or making the hydrogen gas flow in reverse in the water electrolysis device 16, protection of the electrolyte membranes and the like is facilitated, and consequently the durability of the water electrolysis device 16 can be improved.

After the hydrogen pressure has been reduced to a predetermined pressure by performing the pressure release step, and more specifically, after the pressure difference between the anodes 12 and the cathodes 14 of the water electrolysis device 16 has been sufficiently reduced, a water electrolysis termination step is carried out in which the power of the electrolytic power supply 36 and the various solenoid valves and the like provided in the water electrolysis system 10 is turned off (step S7 of FIG. 3), whereupon the flowchart according to the present embodiment is brought to an end.

As described above, according to the water electrolysis system 10 and the control method therefor according to the present embodiment, in accordance with the pressure of the hydrogen gas that is cooled by the Peltier cooler 84, the moisture contained in the hydrogen gas can be effectively separated without undergoing freezing. Therefore, with a small and simple configuration in which the Peltier cooler 84 is used, it is possible to effectively dehumidify the hydrogen gas.

In the water electrolysis system 10 according to the above-described embodiment, there is provided the pressure release valve 82 disposed between the cathodes 14 and the Peltier cooler 84 in the hydrogen gas flow path 18, and which is capable of releasing the pressure between the cathodes 14 and the back pressure valve 20 in the hydrogen gas flow path 18, and the control unit 22 opens the pressure release valve 82 in the case that the temperature measurement value has fallen below the lower limit temperature that is set to be lower than the target temperature, or in the case that the temperature measurement value has exceeded the upper limit temperature that is set to be higher than the target temperature.

Further, in the control method for the water electrolysis system 10 according to the above-described embodiment, the release pressure determination step is performed of determining, after the cooling temperature control step, whether or not the temperature measurement value lies within a range greater than or equal to the lower limit temperature that is set to be lower than the target temperature, and less than or equal to the upper limit temperature that is set to be higher than the target temperature, and the pressure release step is performed of opening the pressure release valve 82, which is disposed between the cathodes 14 and the back pressure valve 20 in the hydrogen gas flow path 18, and releasing the pressure between the cathodes 14 and the back pressure valve 20 in the hydrogen gas flow path 18, in the case it is determined in the release pressure determination step that the temperature measurement value does not lie within the range greater than or equal to the lower limit temperature and less than or equal to the upper limit temperature.

In such cases, even in the event that an abnormality occurs in the control of the cooling temperature of the Peltier cooler 84, a situation can be avoided in which the hydrogen gas flow path 18 and the like become blocked by frozen moisture, and hydrogen gas is produced which is not dehumidified to a predetermined moisture concentration. Further, since it is possible to avoid forcibly stopping the water electrolysis process by the water electrolysis device 16 in a state in which a differential pressure is generated between the anodes 12 and the cathodes 14, and to prevent the hydrogen gas from flowing in reverse in the water electrolysis device 16, the solid polymer electrolyte membranes 46 can be easily protected, and it is possible to enhance the durability of the water electrolysis device 16.

Moreover, the control unit 22 can perform a control of opening the pressure release valve 82 in the case that the temperature measurement value has fallen below the lower limit temperature, or in the case that the temperature measurement value has exceeded the upper limit temperature. For example, in the case that a user of the water electrolysis system 10 issues an instruction to the control unit 22 to terminate operation of the water electrolysis system 10, the pressure release step may be performed to open the pressure release valve 82. Consequently, since the water electrolysis system 10 can be stopped after the differential pressure between the anodes 12 and the cathodes 14 of the water electrolysis device 16 has been sufficiently reduced, it becomes possible to improve the durability of the water electrolysis device 16.

In the water electrolysis system 10 according to the above-described embodiment, the control unit 22 controls the cooling temperature, and after setting the temperature measurement value to the preset starting temperature, initiates electrolysis of water by the water electrolysis device 16.

Further, in the control method for the water electrolysis system 10 according to the above-described embodiment, the water electrolysis step is performed after the preparatory step of controlling the cooling temperature so that the temperature measurement value becomes the preset starting temperature is performed.

In such cases, for example, even in the case that the water electrolysis system 10 is operating under a relatively high temperature in midsummer or the like, since the hydrogen gas can be satisfactorily cooled by the Peltier cooler 84, it becomes possible to efficiently dehumidify the hydrogen gas.

In the control method and the water electrolysis system 10 according to the above-described embodiment, at least a portion of the target temperature is less than or equal to 0° C. When the hydrogen gas pressure is at the set pressure within the range of 70 to 85 MPa, even in the case that the target temperature is less than or equal to 0° C., it is possible to reduce the amount of saturated water vapor while avoiding a situation in which the moisture contained in the hydrogen gas freezes, and therefore, it becomes possible to effectively separate the moisture contained in the hydrogen gas.

The present invention is not particularly limited to the embodiment described above, and various modifications can be adopted therein without departing from the essence and gist of the present invention.

For example, in the above-described embodiment, the Peltier cooler 84 comprises the switching unit 98, and controls the drive current in the cooling direction of the Peltier element 96 to be turned on or off. In this case, it is possible to favorably realize simplification of the Peltier cooler 84. However, the present invention is not particularly limited to this feature. The Peltier cooler 84 may be equipped with a non-illustrated variable power supply or the like, and the cooling temperature may be controlled by adjusting a magnitude of the drive current supplied in at least one of the cooling direction and the heating direction of the Peltier element 96. In this case, the cooling temperature can be controlled with higher accuracy.

Further, in the above-described embodiment, the gas discharge port 94*a* that communicates with the first hydrogen gas flow path 18*a*, and the gas discharge port 94*b* that communicates with the second hydrogen gas flow path 18*b* are provided in the gas-liquid separator 80, and the pressure release valve 82 is provided in the second hydrogen gas flow path 18*b*. However, the present invention is not particularly limited to this feature. The gas-liquid separator 80 may be provided with only the gas discharge port 94*a* that communicates with the first hydrogen gas flow path 18*a*. Further, the pressure release valve 82 may be disposed at any location between the Peltier cooler 84 and the cathodes 14 in the hydrogen gas flow path 18.

What is claimed is:

1. A water electrolysis system comprising a water electrolysis device including an anode configured to generate oxygen gas and a cathode configured to generate hydrogen gas by electrolysis of water, and a back pressure valve provided in a hydrogen gas flow path through which the hydrogen gas generated at the cathode flows, the water electrolysis system producing the hydrogen gas at a higher pressure than the oxygen gas, the water electrolysis system further comprising:

a gas-liquid separator disposed between the cathode and the back pressure valve in the hydrogen gas flow path, and configured to separate moisture from the hydrogen gas;

a Peltier cooler disposed between the gas-liquid separator and the back pressure valve in the hydrogen gas flow path, at a position higher than the gas-liquid separator, and configured to further separate moisture contained in the hydrogen gas by cooling, by a Peltier element, the hydrogen gas from which the moisture has been separated by the gas-liquid separator;

a temperature sensor configured to measure a temperature of the Peltier cooler or a temperature in a vicinity of the Peltier cooler, and to output a temperature measurement value;

a pressure sensor configured to measure a pressure of the hydrogen gas between the cathode and the back pressure valve in the hydrogen gas flow path, and to output a pressure measurement value; and a control unit configured to control a cooling temperature by the Peltier cooler on a basis of the pressure measurement value and the temperature measurement value, in a manner so that the temperature measurement value becomes a target temperature that exceeds a freezing point of water corresponding to the pressure measurement value, wherein at least a portion of the target temperature becomes lower as the pressure measurement value increases.

2. The water electrolysis system according to claim 1, further comprising:

a pressure release valve disposed between the Peltier cooler and the cathode in the hydrogen gas flow path, and configured to release the pressure between the cathode and the back pressure valve in the hydrogen gas flow path, wherein the control unit opens the pressure release valve in a case that the temperature measurement value has fallen below a lower limit temperature set to be lower than the target temperature, or in a case that the temperature measurement value has exceeded an upper limit temperature set to be higher than the target temperature.

3. The water electrolysis system according to claim 1, wherein the control unit controls the cooling temperature, and after setting the temperature measurement value to a preset starting temperature, initiates electrolysis of water by the water electrolysis device.

4. The water electrolysis system according to claim 1, wherein at least a portion of the target temperature is less than or equal to 0° C.

5. A control method for a water electrolysis system comprising a water electrolysis device including an anode configured to generate oxygen gas and a cathode configured to generate hydrogen gas by electrolysis of water, and a back pressure valve provided in a hydrogen gas flow path through which the hydrogen gas generated at the cathode flows, the water electrolysis system producing the hydrogen gas at a higher pressure than the oxygen gas, the control method comprising:

a water electrolysis step of initiating electrolysis of water by the water electrolysis device;

a pressure measurement step of measuring a pressure of the hydrogen gas between the cathode and the back pressure valve in the hydrogen gas flow path, thereby obtaining a pressure measurement value; and a cooling temperature control step of controlling a cooling temperature by a Peltier cooler provided between the cathode and the back pressure valve in the hydrogen gas flow path, in a manner so that a temperature measurement value, which is obtained by measuring a temperature of the Peltier cooler or a temperature in a vicinity of the Peltier cooler, becomes a target temperature that exceeds a freezing point of water corresponding to the pressure measurement value, wherein at least a portion of the target temperature becomes lower as the pressure measurement value increases.

6. The control method for a water electrolysis device according to claim 5, further comprising:

a release pressure determination step of determining, after the cooling temperature control step, whether or not the temperature measurement value lies within a range greater than or equal to a lower limit temperature set to be lower than the target temperature, and less than or equal to an upper limit temperature set to be higher than the target temperature; and a pressure release step of opening a pressure release valve disposed between the back pressure valve and the cathode in the hydrogen gas flow path, and releasing pressure between the back pressure valve and the cathode in the hydrogen gas flow path, in a case it is determined in the release pressure determination step that the temperature measurement value does not lie within the range greater than or equal to the lower limit temperature and less than or equal to the upper limit temperature.

7. The control method for a water electrolysis system according to claim 5, wherein the water electrolysis step is performed after a preparatory step of controlling the cooling temperature so that the temperature measurement value becomes a preset starting temperature is performed.

8. The control method for a water electrolysis system according to claim 5, wherein at least a portion of the target temperature is less than or equal to 0° C.

* * * * *